US007566047B2

(12) United States Patent
Wall

(10) Patent No.: US 7,566,047 B2
(45) Date of Patent: Jul. 28, 2009

(54) CONNECTION SYSTEM FOR PLASTIC WEB FENCING

(75) Inventor: John R. Wall, Carmichaels, PA (US)

(73) Assignee: John Wall, Inc., Carmichaels, PA (US)

( * ) Notice: Subject to any disclaimer, the term of this patent is extended or adjusted under 35 U.S.C. 154(b) by 0 days.

(21) Appl. No.: 10/719,352

(22) Filed: Nov. 21, 2003

(65) Prior Publication Data

US 2005/0109999 A1 May 26, 2005

(51) Int. Cl.
*E04H 17/02* (2006.01)

(52) U.S. Cl. ..... 256/48; 256/32; 256/45

(58) Field of Classification Search ..... 256/24, 256/25, 45, 46, 47, 50, 51, 54, 32, 48, 65.01, 256/65.15, 65.02, 12.5, 33, 37, 49, 52, 53, 256/34; 24/265 AL, 265 C, 200, 71.1, 197, 24/68 F, 68 E, 1, 5, 67, DIG. 2, 198
See application file for complete search history.

(56) References Cited

U.S. PATENT DOCUMENTS

| | | | | | |
|---|---|---|---|---|---|
| 195,723 | A | * | 10/1877 | Nellis | 256/52 |
| 327,731 | A | * | 10/1885 | Sinclair | 24/197 |
| 349,482 | A | * | 9/1886 | Collins | 226/183 |
| 597,583 | A | * | 1/1898 | Kopka | 256/45 |
| 787,747 | A | * | 4/1905 | Gilmore | 245/2 |
| 2,582,579 | A | * | 1/1952 | Bedford, Jr. | 24/308 |
| 3,552,613 | A | * | 1/1971 | Nye | 224/406 |
| 3,648,981 | A | | 3/1972 | Allen | |
| 3,858,279 | A | * | 1/1975 | Brattstrom | 24/68 F |
| 3,933,311 | A | | 1/1976 | Lemelson | |
| 3,963,219 | A | | 6/1976 | D'Amico | |
| 4,171,555 | A | * | 10/1979 | Bakker et al. | 24/200 |
| 4,191,361 | A | | 3/1980 | Jensen | |
| 4,465,263 | A | * | 8/1984 | Robbins, Jr. | 256/52 |
| 4,526,348 | A | * | 7/1985 | Cammack | 256/65.06 |
| 4,684,107 | A | | 8/1987 | Robbins, Jr. | |
| RE32,707 | E | * | 7/1988 | Robbins, Jr. | 256/52 |
| 4,791,709 | A | * | 12/1988 | Fildan | 24/171 |
| 4,860,996 | A | | 8/1989 | Robbins, III | |
| 4,866,218 | A | * | 9/1989 | Wilson, Jr. | 256/10 |
| 4,905,968 | A | * | 3/1990 | Eby et al. | 256/47 |
| 4,932,634 | A | | 6/1990 | Sura | |

(Continued)

OTHER PUBLICATIONS

J.L Williams Company "Safe Fence" website Apr. 8, 2001, [online], [retrieved on Jul. 11, 2005] retrieved from the internet archive "wayback machine" database using Internet <URL:http://web.archive.org/web/20010311153850/www.safefence.com>.*

*Primary Examiner*—Michael P Ferguson
(74) *Attorney, Agent, or Firm*—The Webb Law Firm

(57) ABSTRACT

A fencing system includes a rail having at least two metal wires ensheathed in a plastic web, an end connector having a face plate with two slots and a middle portion separating the two slots, the end connector having a front side and a rear side. A free end of the rail is disposed in the slotted end connector so that the rail runs from the front side of the connector through a first slot, around the middle portion, and then back through a second slot. A fastener pivotally attaches the end connector to a fence post. Also, a joining connector of similar construction as the end connector is used to secure the free ends of two rails.

1 Claim, 7 Drawing Sheets

U.S. PATENT DOCUMENTS

| | | | | |
|---|---|---|---|---|
| 4,951,925 | A | 8/1990 | Schultz et al. | |
| 4,964,618 | A | 10/1990 | Kennedy et al. | |
| 4,973,029 | A | 11/1990 | Robbins, III | |
| 5,011,349 | A * | 4/1991 | McAndrews | 24/197 |
| 5,100,109 | A | 3/1992 | Robbins, III | |
| 5,439,201 | A | 8/1995 | Landreville | |
| 5,556,079 | A | 9/1996 | West | |
| 5,644,822 | A * | 7/1997 | Frew | 24/196 |
| 5,661,878 | A * | 9/1997 | Johnson, III | 24/200 |
| 6,325,347 | B1 * | 12/2001 | Crichton | 248/228.1 |
| 6,533,881 | B1 | 3/2003 | Wall | |
| 2001/0015427 | A1 | 8/2001 | Berto | |
| 2002/0063248 | A1 | 5/2002 | Siegler et al. | |

* cited by examiner

CONNECTION SYSTEM FOR PLASTIC WEB FENCING

BACKGROUND OF THE INVENTION

1. Field of the Invention

The present invention relates to plastic web fencing and, more specifically, to methods and devices for securing plastic web fencing to end fence posts and for joining two ends of web fencing in between posts.

2. Description of Related Art

Composite metal and plastic fencing is well-known in the art. Plastic web fencing is typically constructed of two metal wires spaced a distance apart and ensheathed in plastic, with the plastic forming a web area extending between the wires. Plastic web fencing is known as an inexpensive and safe alternative to other commonly employed materials used in the construction of fences, such as wood and barbed wire. Wood suffers from the disadvantages that it is expensive to install and maintain and, further that it has a tendency to weather and rot over time. Barbed wire fencing is a relatively low cost means for enclosing livestock areas. However, barbed wire fencing suffers from the disadvantage that its sharp barbs may cut or gouge the hide of valuable livestock animals, such as horses.

Prior art plastic web fencing has been affixed to posts or poles, for example, with clamps as disclosed by U.S. Pat. No. Re 32,707 to Robbins, Jr. (hereinafter "the Robbins patent") or with attachment ears, as disclosed by U.S. Pat. No. 4,932,634 to Sura (hereinafter "the Sura patent"). The Sura patent is directed to fencing applications not requiring a great deal of strength, such as for snow fencing, as opposed to confining livestock. Nor does the Sura patent appear to address the problems of connecting composite metal and plastic fencing to fence posts, or joining two ends of such fencing in between posts. The same shortcomings appear to be present in the Robbins patent. Also, some of the embodiments in the Robbins patent actually puncture the fence rail, which could lead to premature deterioration of the rail.

Furthermore, the connection systems disclosed in both the Robbins patent and the Sura patent do not easily conform to uneven terrain over which the plastic web fencing may be deployed. For example, if fence posts need to be introduced on a hillside, the connection systems in the above-discussed prior art are not able to provide the necessary angles that would keep the ribbon on the same plane as the ground surface.

SUMMARY OF THE INVENTION

The present invention is directed to a plastic web fencing system, which requires minimal tools when installing the rail on the posts. Additionally, the plastic web fencing system may accommodate the rails at angles that conform to an uneven terrain. In addition to securing the rails to fence posts, the present invention also allows the rails to be quickly and easily attached to one another to create a single, continuous rail, without the use of any tools.

The fencing system includes a rail having at least two metal wires ensheathed in a plastic web, an end connector having a face plate with two slots and a middle portion separating the two slots, and the end connector having a front side and a rear side. A free end of the rail is disposed in the slotted end connector so that the rail runs from the front side of the connector through a first slot nearest the face plate, around the middle portion, and then back through the second slot. A fastener attaches the end connector to a fence post and the fastener preferably allows the end connector to pivot on the post. Also, a joining connector of similar construction as the end connector is used to secure the free ends of two rails. A method for securing the rail to the end connector and for securing the free ends of two rails to a joining connector is also disclosed.

These and other advantages of the present invention will be understood from the description of the preferred embodiments, taken with the accompanying drawings, wherein like reference numerals represent like elements throughout.

DETAILED DESCRIPTION OF THE PREFERRED EMBODIMENTS

Figure 1:
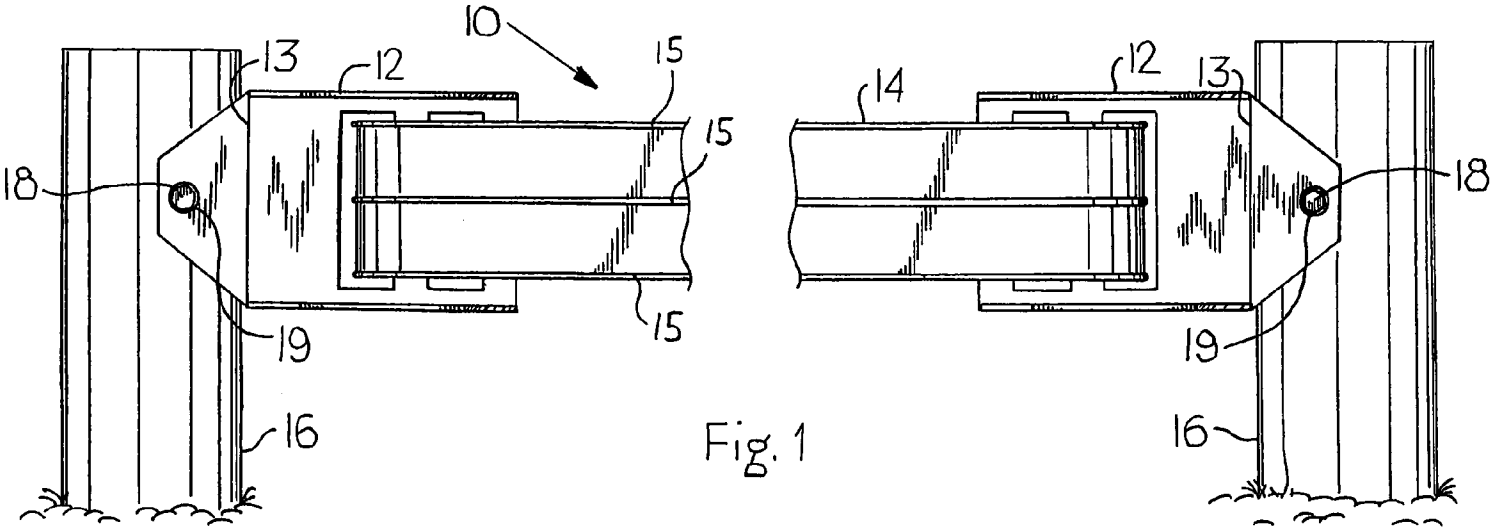
FIG. 1 is a front view of a first embodiment plastic web fencing system utilizing two end connectors, in accordance with the present invention.

For purposes of the description hereinafter, the spatial or directional terms, such as "bottom", "front", "back", "left", "right", and derivatives thereof, shall relate to the invention as it is oriented in the drawing figures. However, it is to be understood that the invention may assume various alternative variations, except where expressly specified to the contrary. It is also to be understood that the specific apparatus illustrated in the attached drawings, and described in the following specification, is simply an exemplary embodiment of the invention. Hence, specific dimensions and other physical characteristics related to the embodiments disclosed herein are not to be considered as limiting.

Figure 2:
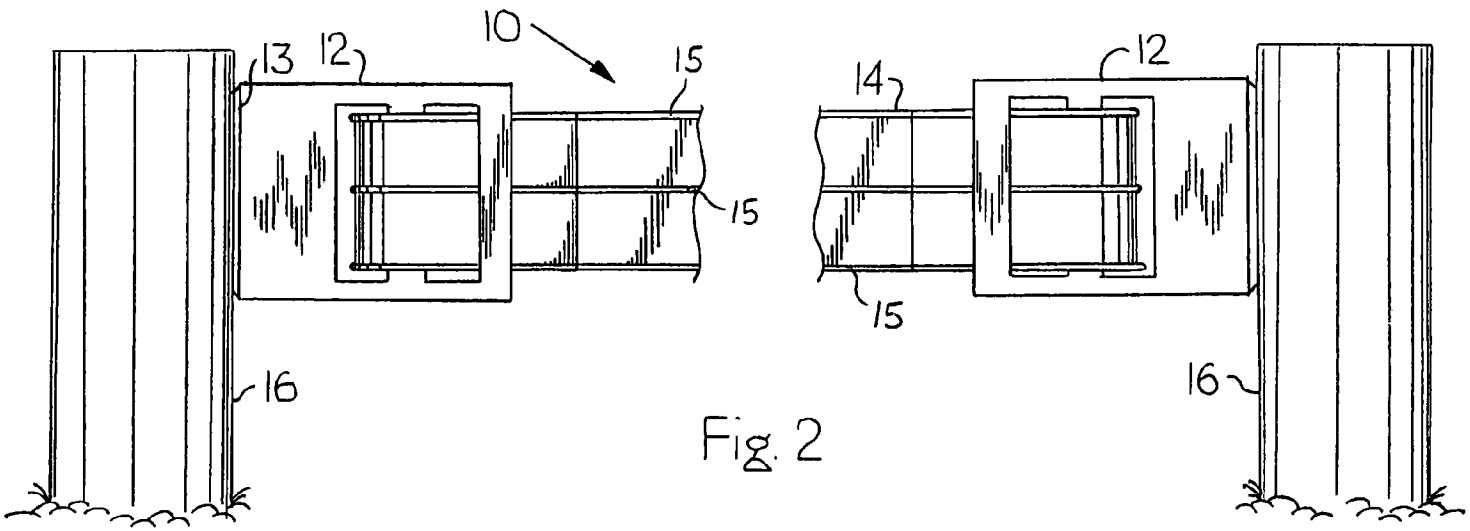
FIG. 2 is a rear view of the first embodiment plastic web fencing system of FIG. 1, in accordance with the present invention.

Referring now to the drawings in detail, FIGS. 1 and 2 show a plastic web fencing system 10 according to a first embodiment of the present invention. The first embodiment plastic web fencing system 10 includes one or more end connectors 12, a rail 14, one or more fence posts 16, and one or more fasteners 18. Briefly, each end connector 12 is attached to a corresponding fence post 16 by the fastener 18 at a 45° angle. A washer 19 may be used behind each fastener 18. Each end of the rail 14 is secured to a respective end connector 12. Optionally, the end connector 12 may have a bend 13 between the fastener 18 and a slot 22*b*, as shown in FIG. 3.

The rail 14 is of composite construction; namely, including two or more metal wires 15 spaced a distance apart, ensheathed in plastic, with the plastic forming a web area extending between the wires 15. The wires 15 are shown in phantom in FIG. 4. This construction is conducive to manual deformation of the rail 14, yet retaining a high degree of stiffness in the rail 14. It is to be understood that any other type of rail fencing exhibiting stiffness and deformability qualities inherent in composite metal and plastic web fencing may also be utilized. For example, in the preferred embodiment, the rail 14 is rigid enough that, when a section of it is placed on an edge of a tabletop, it is self-supporting.

The fence post 16 is of ordinary construction made of wood, plastic, metal, or composite material. The fence post 16 may be as simple as a pole-like object inserted into the ground and extending upward vertically therefrom. The plastic web fencing system is envisioned to work with new fence posts as well as existing fence posts. For hardwood fence posts, the fastener 18 may be a simple lag bolt, whereas with softer woods, a throughbolt with a nut secured on the distal end may be required. It is to be understood that stationary objects and structures, such as a side of a building, may also be considered as a fence post for the purpose of attaching the end connector 12 thereto.

Figure 3:
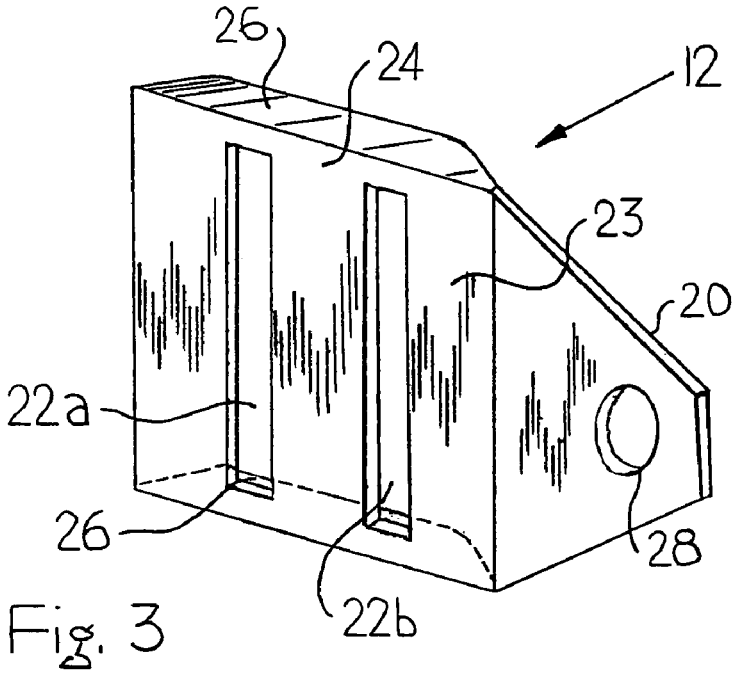
FIG. 3 is a rear perspective view of one of the end connectors of FIG. 1, in accordance with the present invention.
Figure 4:
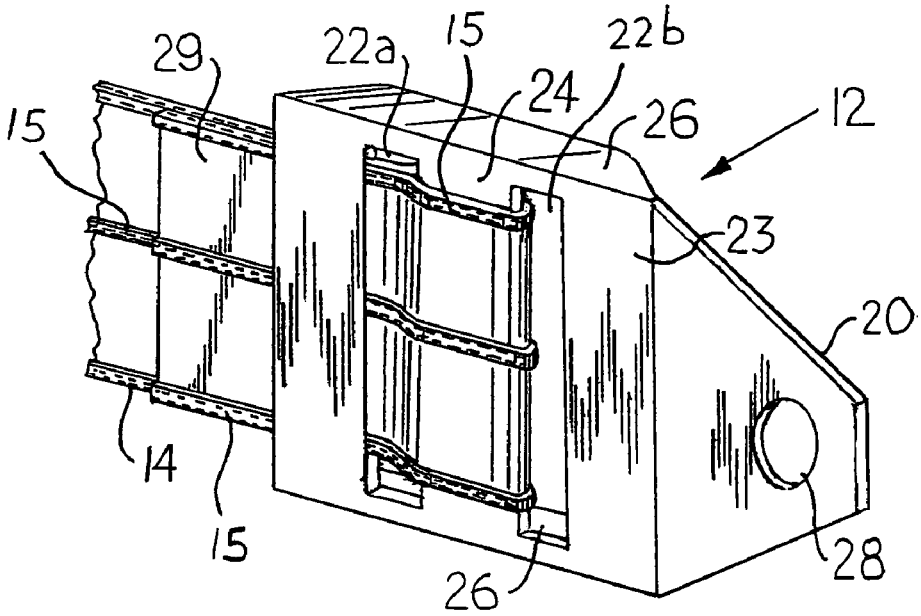
FIG. 4 is a rear perspective view of the end connector of FIG. 3 with a first rail secured thereto, in accordance with the present invention.

With continuing reference to FIG. 1, FIGS. 3 and 4 illustrate the end connector 12 in greater detail. Specifically, in FIG. 3, the end connector 12 is a rigid member 20 that may be constructed from a variety of materials including, but not limited to, steel (e.g., ⅛" mild steel) or other metals, composite materials, or high strength plastic. The thickness of the rigid member 20 may be approximately ⅛", having a holding strength better than 50% of the breaking strength of the rail 14. The end connector 12 has a front side and a rear side with the front side being that which faces outward from the area being enclosed by the fence upon installation of the end connector 12. The front sides of the end connectors 12 are those shown in FIG. 1. The end connector 12 includes a first slot 22*a* and a second slot 22*b*. The first slot 22*a* and the second slot 22*b* are preferably parallel to each other. The end connector 12 has a face plate 23, and a middle portion 24 separates the first slot 22*a* from the second slot 22*b*. The first slot 22*a* and the second slot 22*b* extend through the thickness of the rigid member 20. The spacing relationship between the first slot 22*a* and the second slot 22*b* is conducive to having the rail 14 threaded therethrough in a buckling arrangement, as shown in FIG. 4. Optionally, the end connector 12 may include one or more return edges 26 extending along opposing sides of the rigid member 20. Preferably, the return edges 26 are continuous with and perpendicular to the rigid member 20. The joints at which the return edges 26 meet the rigid member 20 may be rounded, as opposed to square, as to eliminate any sharp corners which may pose a hazard to personnel or livestock. Similarly, any other portions of the rigid member 20 having sharp corners may also be rounded off. The rigid member 20 also includes a throughhole 28 adapted to receive the fastener 18.

Figure 8:
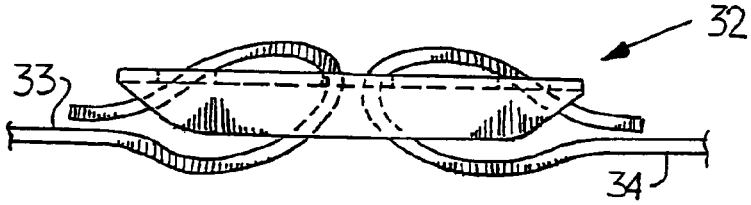
FIG. 8 is a top view of the joining connector of FIG. 6 showing the first rail and the second rail secured thereto, in accordance with the present invention.
Figure 9:
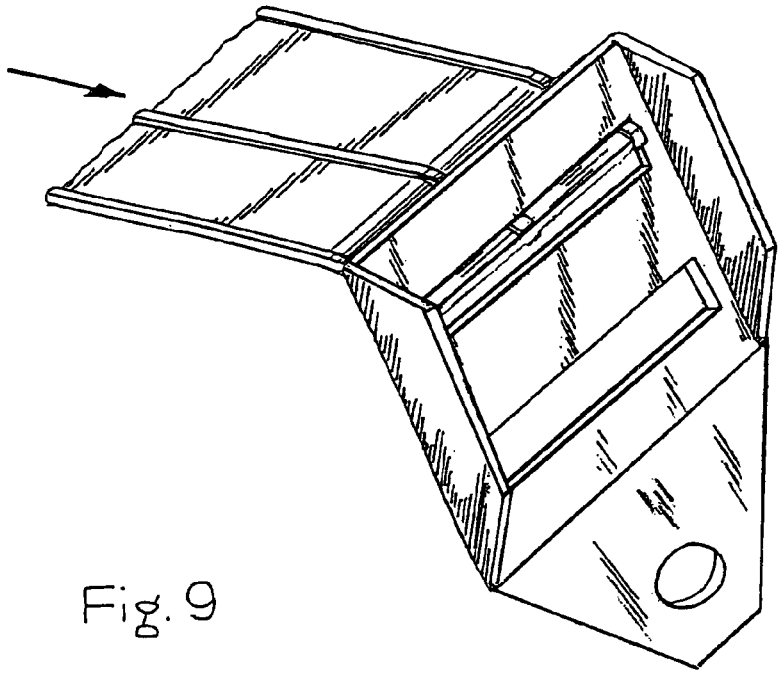
FIGS. 9-14 are perspective views illustrating a method of securing a first rail to an end connector.
Figure 10:
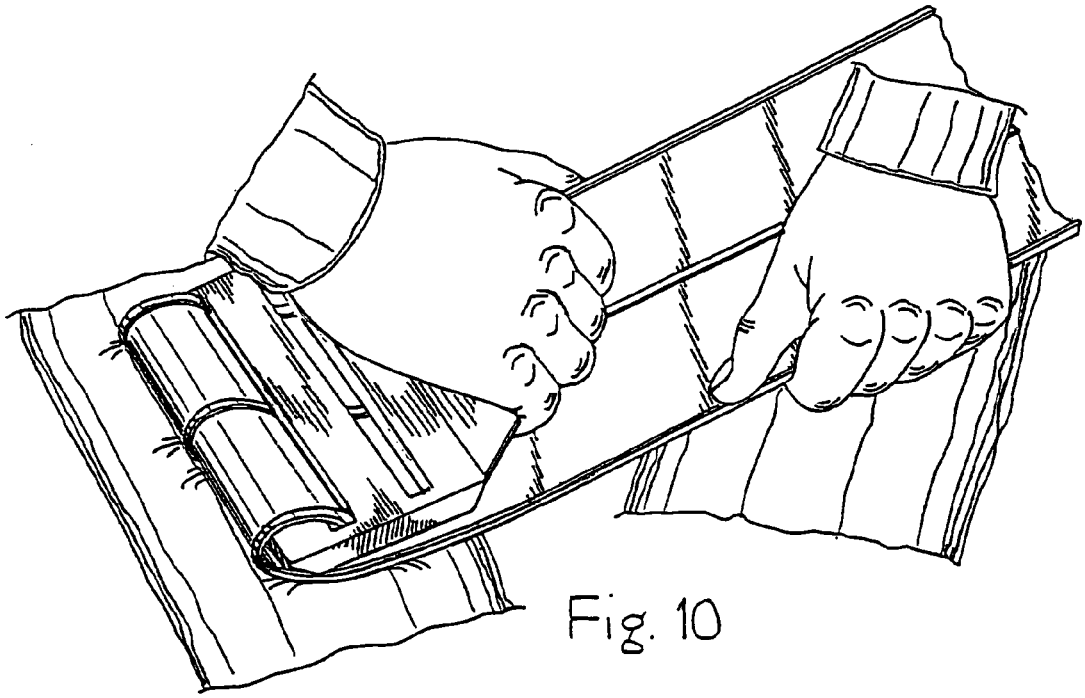
Figure 11:
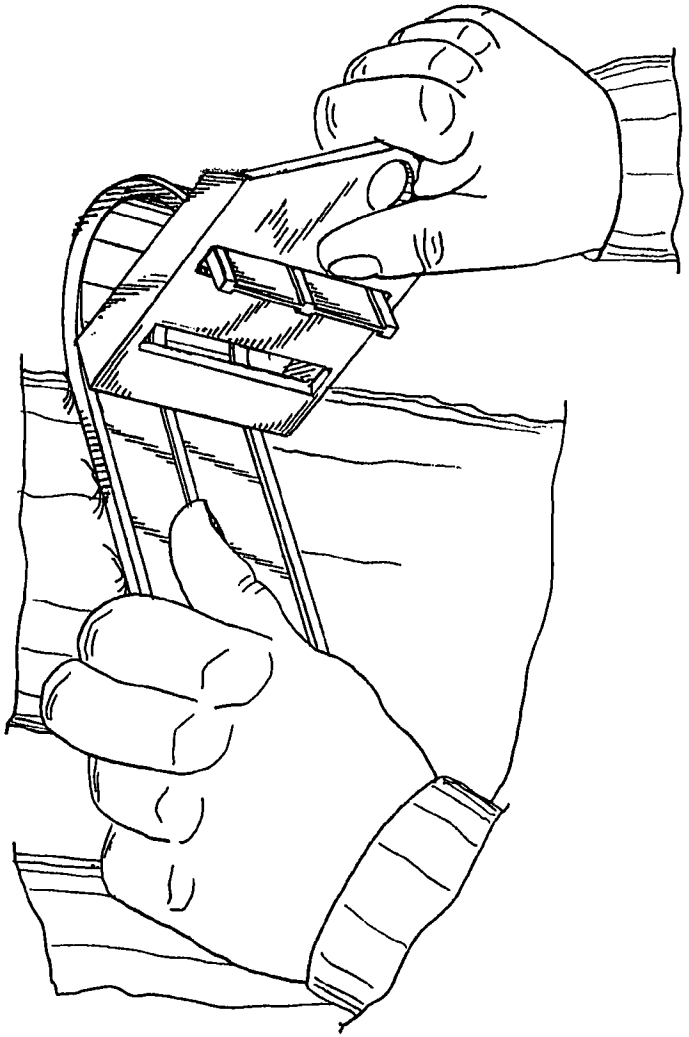
Figure 12:
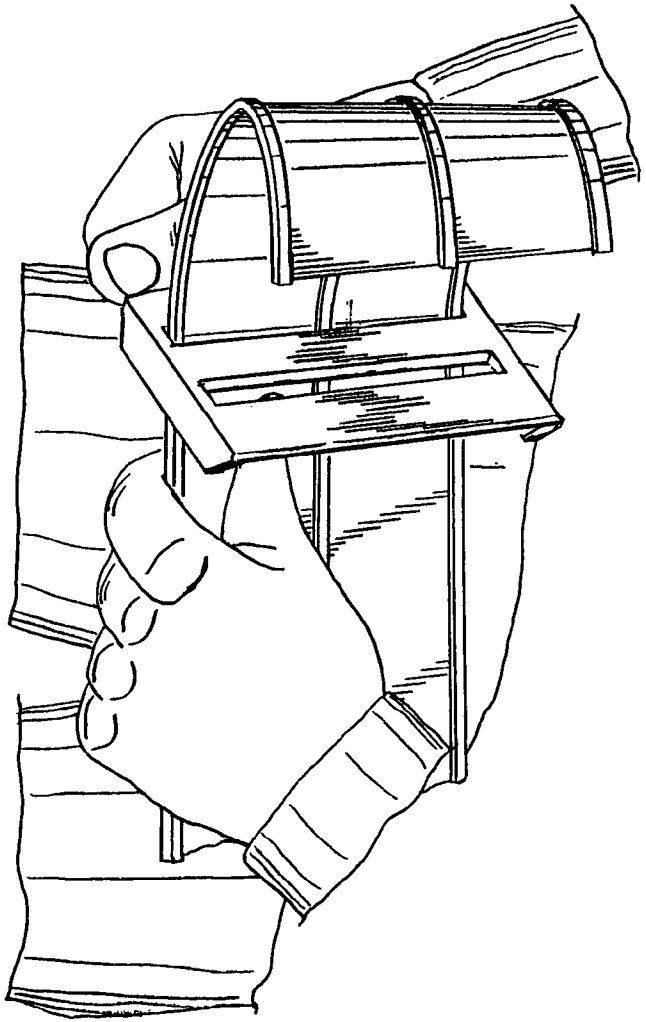
Figure 13:
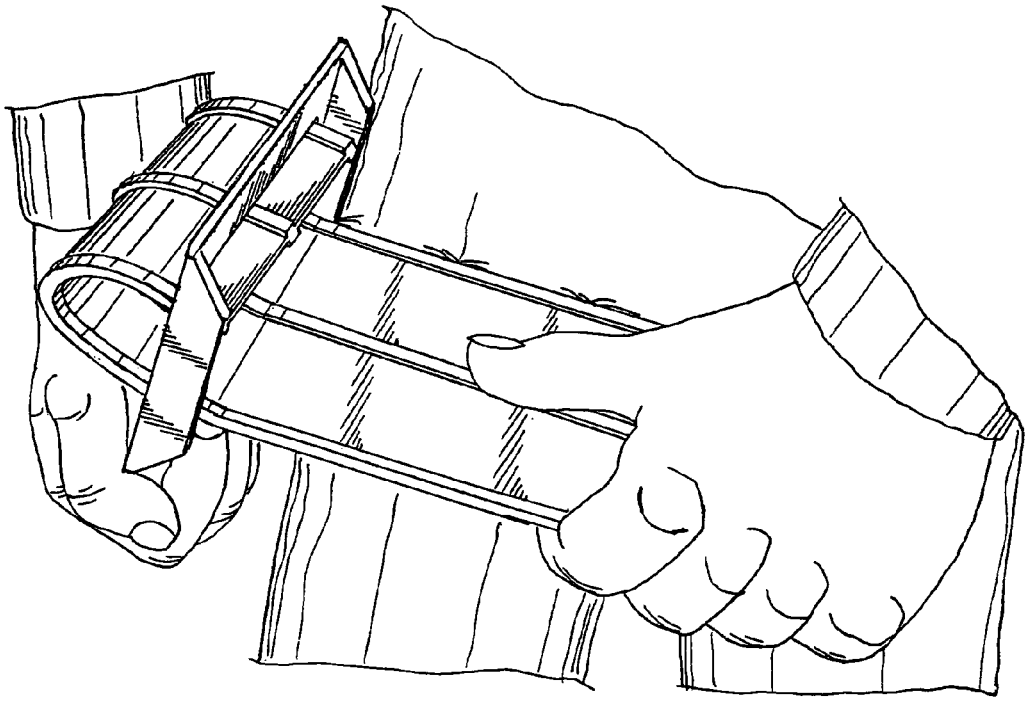
Figure 14:
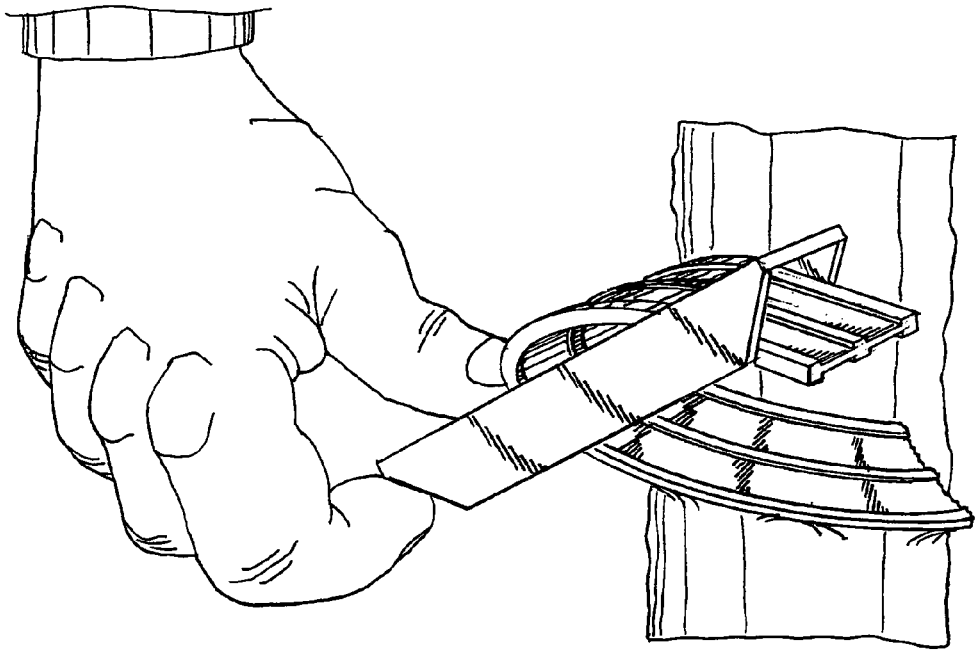

With reference to FIGS. 9-14, a method of connecting the rail 14 to the end connector 12 will now be described. As shown in FIG. 9, a free end 29 of the rail 14 is partially inserted into the slot 22*a*. FIG. 10 shows how the end connector 12 is leveraged as a tool in order to crimp the rail 14 a few inches away from the free end 29. The free end 29 is then removed from the end connector 12 and thereafter the position of the end connector 12 is reversed. As shown in FIG. 11, the free end 29 of the rail 14 is inserted from the front of the end connector 12 through the slot 22*b*. The end connector 12 is then moved past the crimped portion of the rail 14 as shown in FIG. 12. As shown in FIG. 13, the free end 29 may now be inserted from the rear of the end connector 12 through the slot 22*a*. The end connector 12 is now pivoted clockwise to secure the rail 14 therein, as shown in FIG. 14. The end connector 12 is thereby placed substantially in line with the longitudinal axis of the rail 14 as exemplified in FIG. 8. As illustrated in FIG. 1, the end connector 12 and the rail 14 are aesthetically pleasing, with the free end 29 hidden from view at the rear of the end connector 12.

This buckling arrangement removably secures the end connector 12 to the rail 14. The end connector 12 may then be attached to the fence post 16 using the fastener 18. When the throughhole 28 is used in conjunction with an appropriate fastener 18, such as a lag bolt and washer 19, the end connector 12 may pivot about the fastener 18. This rotational movement allows the end connector 12 to be positioned in various angled positions, thereby not limiting the rail 14 to a perpendicular relation with the fence post 16. In practical terms, this feature allows the fence post 16 to be situated at the top or bottom of a hill, thereby allowing the plastic web fencing system 10 to be pivoted with respect to the post, so that the rail 14 remains parallel to the terrain. It is to be understood that other types of fasteners may provide the same pivoting capabilities to end connectors.

As shown in FIGS. 1 and 2, at least two end connectors are utilized in the plastic web fencing system 10. Therefore, another end connector 12 is secured to the other free end of the rail 14. The buckling arrangement of any other end connector 12 is substantially the same as the aforementioned buckling arrangement and method, except the final rotation of the end connector 12 would be counterclockwise instead of clockwise. The operation of securing the rail 14 to end connector 12 requires no tools, as the rail 14 may be easily deformed and threaded through the end connector 12 using the connector itself and hand strength alone.

Figure 5:
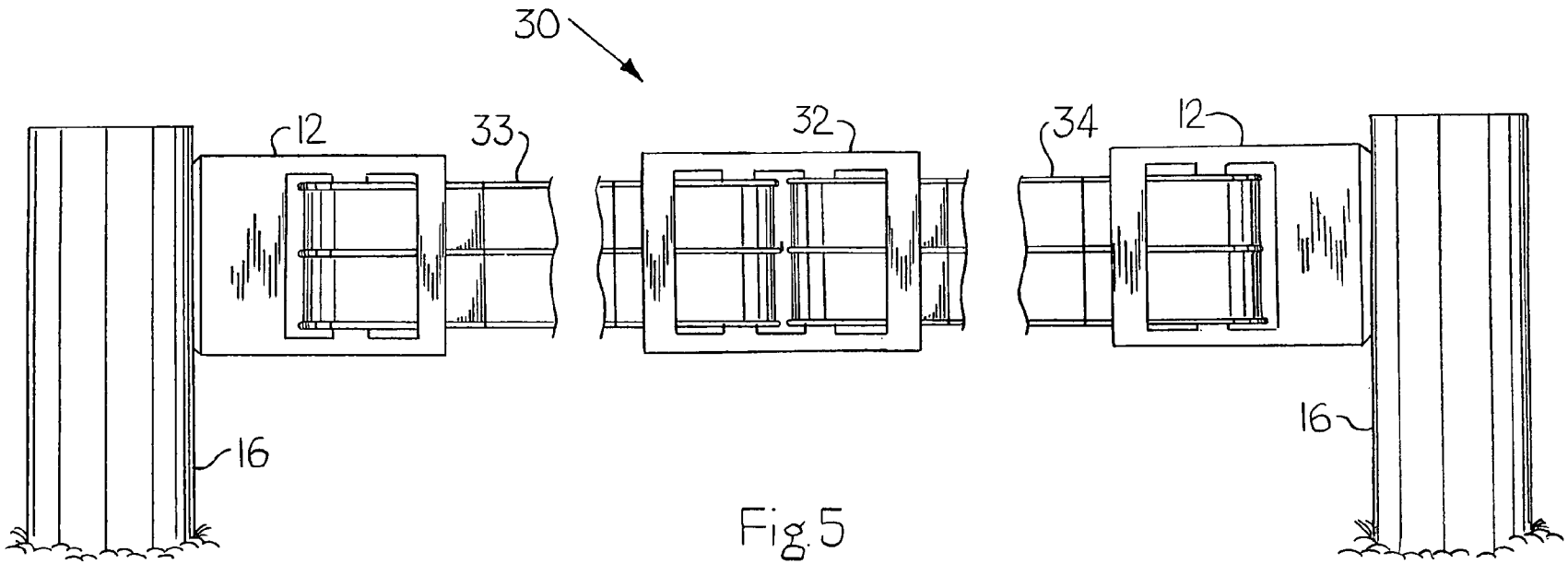
FIG. 5 is a rear view of a second embodiment plastic web fencing system utilizing two end connectors and a joining connector, in accordance with the present invention.

With continuing reference to FIGS. 1 and 2, FIG. 5 illustrates a plastic web fencing system 30 according to a second embodiment. In addition to the elements embodied in the first embodiment plastic web fencing system 10, the second embodiment plastic web fencing system 30 includes a joining connector 32. The joining connector 32 serves to connect the free end of one rail 14 with the free end of another rail 14. The joining connector 32 is useful when a spool of rail has run out and there is an insufficient length of rail 14 to completely span the distance between two posts 16. A new rail can be joined to the end of the existing rail 14 with no tools and no wasted footage of the expensive rail material.

Figure 6:
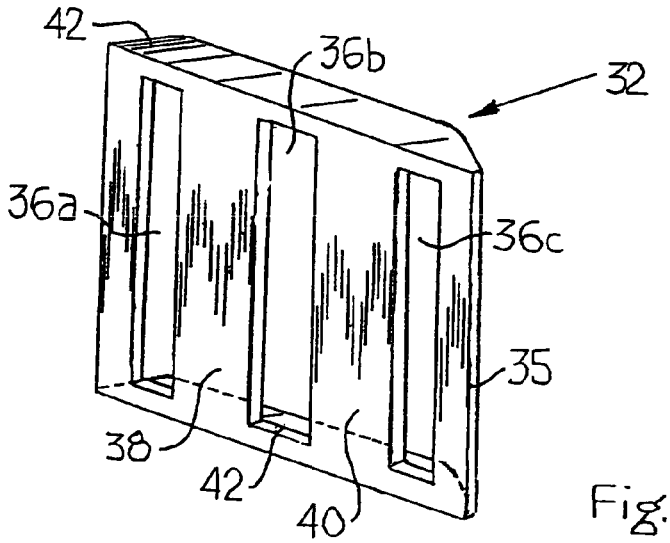
FIG. 6 is a rear perspective view of the joining connector of FIG. 5, in accordance with the present invention.
Figure 7:
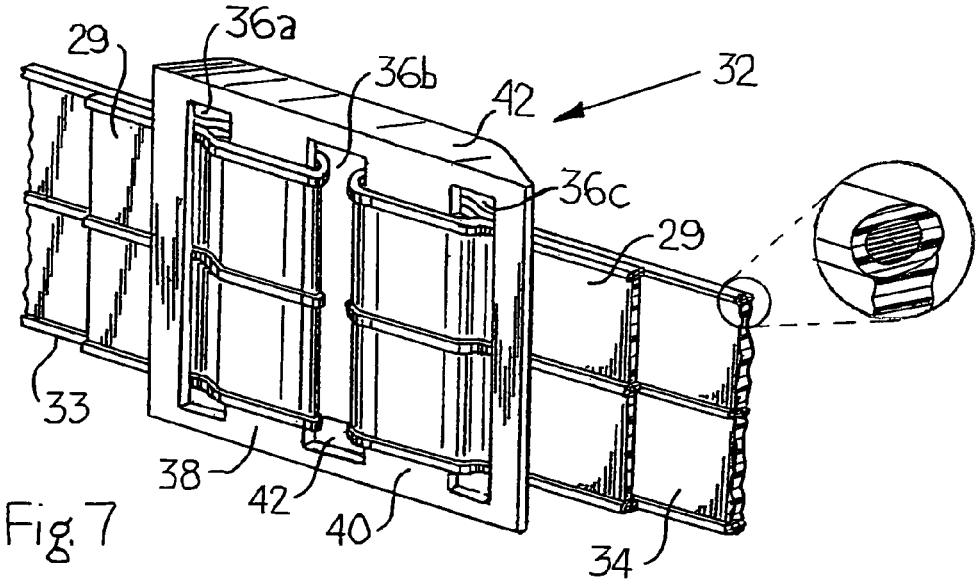
FIG. 7 is a rear perspective view of the joining connector of FIG. 5 with the first and a second rail secured thereto, in accordance with the present invention.

With continuing reference to FIG. 5, FIGS. 6 and 7 illustrate the joining connectors 32 in greater detail. The joining connector 32 is adapted to provide a buckling arrangement in conjunction with a left rail 33 and a right rail 34. Thus, the joining connector 32 is of similar construction as the end connector 12 but can accommodate the abutting free ends of two rails 33, 34 as opposed to the free end of only one rail 14. The joining connector 32 is also a rigid member 35 that may be constructed from a variety of materials similar to the end connector 12. The thickness of the rigid member 35 may be approximately ⅛", having a holding strength better than 50% of the breaking strength of rail 14. The joining connector 32 includes a first slot 36*a*, a second slot 36*b*, and a third slot 36*c*. The first, second, and third slots 36*a*-36*c* are preferably parallel to each other. The first slot 36*a* and the third slot 36*c* need only be slightly wider than the thickness of the left rail 33 and right rail 34, respectively. The second slot 36*b* may be slightly wider than the first slot 36*a* and the third slot 36*c* so as to accommodate the thicknesses of both the left rail 33 and the right rail 34. A first portion 38 and a second portion 40 of the rigid member 35 separates the first slot 36*a* from the second slot 36*b* and the second slot 36*b* from the third slot 36*c*, respectively. The first, second, and third slots 36*a*-36*c* extend through the thickness of the rigid member 35. The slot 36*b* is only slightly larger than slots 36*a* and 36*c*, but slot 36*b* should be kept small enough that a gap between abutting ends of the rails is not obvious to the eye when installed in the joining connector 32. Optionally, the joining connector 32 may include one or more return edges 42 extending along opposing sides of the rigid member 35. Preferably, the return edges 42 are continuous with and perpendicular to the rigid member 35. The points at which the return edges 42 meet the rigid member 35 may be curved, as opposed to square, as to eliminate any sharp comers which may pose a hazard. Similarly, any other portions of the rigid member 35 having sharp comers may also include curves as opposed to straight angles.

Each rail 33, 34 is threaded through the joining connector 32 in a similar manner as the single rail 14 is threaded through the end connectors 12. Thus, the method shown in FIGS. 9-14 with reference to the end connector 12 may also be applied to the joining connector 32. Specifically, the joining connector 32 may be utilized as the crimping tool to crimp each rail 33, 34. After each rail 33, 34 has been threaded through the corresponding slots in the joining connector 32, the joining connector 32 and the rails 33, 34 are visually pleasing from the front of the fence, with the free ends 29 hidden from view at the rear of the joining connector 32. FIG. 7 shows a different view as to how the left and right rails 33, 34 are threaded through the joining connector 32. Thus, this buckling arrangement removably secures the joining connector 32 to both the left and right rails 33, 34. It is to be understood that ends of the left and right rails 33, 34 not threaded to the joining connector 32 may be threaded to either an end connector 12 or additional joining connector 32. The latter option would increase the length of a rail 14, 33, or 34 so as to span an even greater distance between posts.

Returning to FIG. 5, with continuing reference to FIGS. 1 and 2, as is the case with the end connector 12, the joining connector 32 offers similar benefits when used in the second embodiment plastic web fencing system 32. The use of the end connector 12 and the joining connector 32 provide an aesthetic connection system which is secure, reliable, and can be installed using minimal tools. It is envisioned that plastic insulated grommets (or similar adaptations) can be included on end connectors 12 and joining connectors 32, so that the connectors can be used to construct an electrified fence.

The above invention has been described with reference to the preferred and alternative embodiments. Obvious modifications, combinations, and alterations will occur to others upon reading the preceding detailed description. It is intended that the invention be construed as including all such modifications, combinations, and alterations insofar as they come within the scope of the appended claims or the equivalents thereof.

The invention claimed is:

1. A fencing system, comprising:

a first rail consisting of at least two metal wires ensheathed in a plastic web, wherein the first rail is rigid yet manually deformable in the absence of any assembly thereof with the fencing system;

a first slotted connector made of steel having a face plate with a throughhole and a first and second slot formed within the face plate in a planar surface thereof, the first slotted connector including a substantially planar middle portion separating the two slots, the first slotted connector having a front side and a rear side and also having a post attachment end comprising the throughhole, wherein the first slotted connector comprises return edges extending along opposing sides of the face plate, the return edges extending perpendicularly outward from the front side of the face plate for guiding the first rail therebetween, wherein the face plate includes a bend between the first slot and the post attachment end;

a first free end of the first rail being disposed in the first slotted connector so that the first rail runs from the front side of the first slotted connector through the first slot nearest the post attachment end, around the middle portion, and then back through the second slot;

a wood post having a substantially circular cross section to which the first slotted connector is attached using a first fastener inserted through the throughhole of the post attachment end such that the rear side of the first connector pivotably abuts the post, which permits the first slotted connector to pivot about the first fastener, wherein the first fastener is a lag bolt;

a second rail consisting of at least two metal wires ensheathed in a plastic web, wherein the second rail is rigid yet manually deformable in the absence of any assembly thereof with the fencing system;

a second slotted connector made of steel having a face plate with a throughhole and a first and second slot formed within the face plate of the second connector in a planar surface thereof, the second slotted connector including a substantially planar middle portion separating the two slots, the second slotted connector having a front side and a rear side and also having a post attachment end comprising the through hole of the second connector, wherein the second slotted connector comprises return edges extending along opposing sides of the face plate of the second connector, the return edges extending perpendicularly outward from the front side of the face plate for guiding the second rail therebetween, wherein the face plate includes a bend between the first slot and the post attachment end of the second connector;

a first free end of the second rail being disposed in the second slotted connector so that the second rail runs from the front side of the second slotted connector through the first slot nearest the post attachment end of the second connector, around the middle portion, and then back through the second slot of the second connector;

a second wood post having a substantially circular cross section to which the second slotted connector is attached using a second fastener inserted through the throughhole of the post attachment end of the second connector such that the rear side of the second connector pivotably abuts the second post, which permits the second slotted connector to pivot about the second fastener, wherein the second fastener is a lag bolt;

a slotted joining connector having a face plate with a first slot, a second slot, and a third slot, the slotted joining connector having a front side and a rear side, a substantially planar middle portion separating the first slot and the second slot and a substantially planar middle portion separating the second slot and the third slot;

a second free end of the first rail being disposed in the slotted joining connector so that the second rail runs from the front side of the slotted joining connector through the second slot of the joining connector, around the middle portion separating the first slot and the second slot of the joining connector, and then back through the first slot; and a second free end of the second rail being disposed in the slotted joining connector so that the second rail runs from the front side of the slotted joining connector through the second slot of the joining connector, around the middle portion separating the second slot and the third slot of the joining connector, and then back through the third slot.

* * * * *